US005670194A

United States Patent [19]

Fuller et al.

[11] Patent Number: 5,670,194

[45] Date of Patent: Sep. 23, 1997

[54] BEVERAGE CONTAINER HAVINGING INTERIOR SECONDARY CHAMBER FOR FOAM GENERATION AND METHOD FOR PRODUCING SAME

[75] Inventors: Graham Fuller, Bedford; Anthony John Banks, Birmingham; Raymond Gale Anderson, Staffordshire, all of England

[73] Assignee: Carlsberg-Tetley Brewing Limited, Burton-on-Trent, England

[21] Appl. No.: 351,339

[22] PCT Filed: Jun. 14, 1993

[86] PCT No.: PCT/GB93/01253

§ 371 Date: Mar. 9, 1995

§ 102(e) Date: Mar. 9, 1995

[87] PCT Pub. No.: WO93/25452

PCT Pub. Date: Dec. 23, 1993

[30] Foreign Application Priority Data

Jun. 12, 1992 [GB] United Kingdom ..... 9212464

[51] Int. Cl.[6] ..... B65B 31/00; B65B 17/00; B65B 25/00; B28B 5/00

[52] U.S. Cl. ..... 426/112; 426/115; 426/124; 426/131; 426/132; 206/222; 220/501; 220/553; 425/72.1; 425/396

[58] Field of Search ..... 426/106, 112, 426/115, 124, 131, 397, 398, 394, 474, 477; 53/420, 432, 433, 471, 474; 425/72.1, 371, 396; 206/222; 220/501, 553, 906

[56] References Cited

U.S. PATENT DOCUMENTS

| | | | |
|---|---|---|---|
| 3,981,663 | 9/1976 | Lupke | 425/326 B |
| 4,545,751 | 10/1985 | Lupke | 425/72 R |
| 4,801,465 | 1/1989 | Sponer | 426/116 |

FOREIGN PATENT DOCUMENTS

| | | |
|---|---|---|
| 1385556 | 1/1965 | France . |
| 2183592 | 6/1987 | United Kingdom . |
| 8704405 | 7/1987 | WIPO . |

*Primary Examiner*—Esther Kepplinger
*Assistant Examiner*—Curtis E. Sherrer
*Attorney, Agent, or Firm*—Charles E. Baxley, Esq.

[57] ABSTRACT

A container of beverage sealed under pressure is provided with a secondary chamber in the form of a hollow insert adapted to provide a flow of gas through an orifice into the beverage when the container is opened. The insert is in the form of an elongate tubular member whose axis extends around an axis corresponding generally to the axis of the container.

19 Claims, 6 Drawing Sheets

FIG. 4.
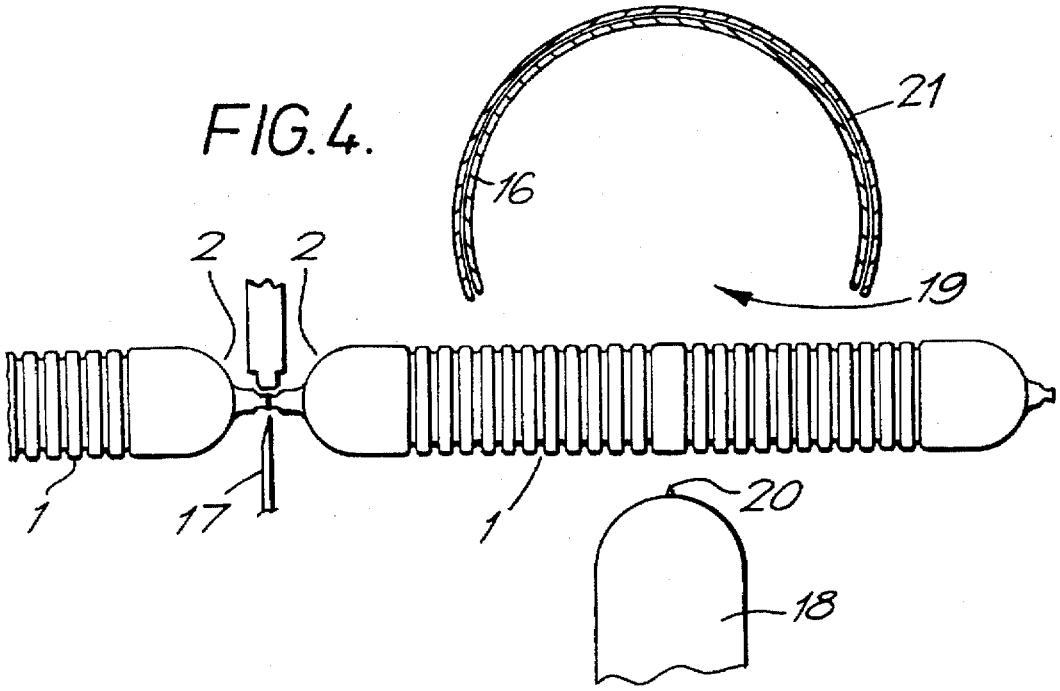
FIG. 5a.
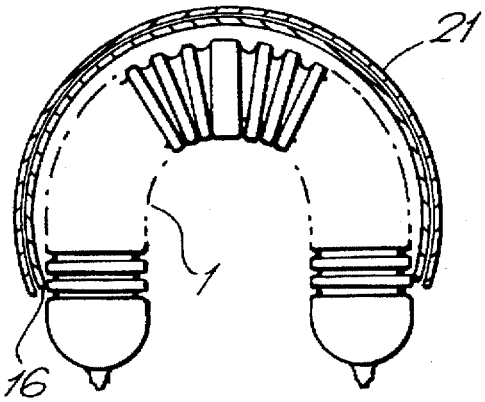
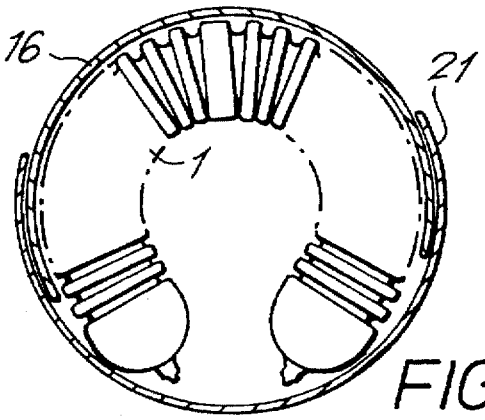
FIG. 5b.
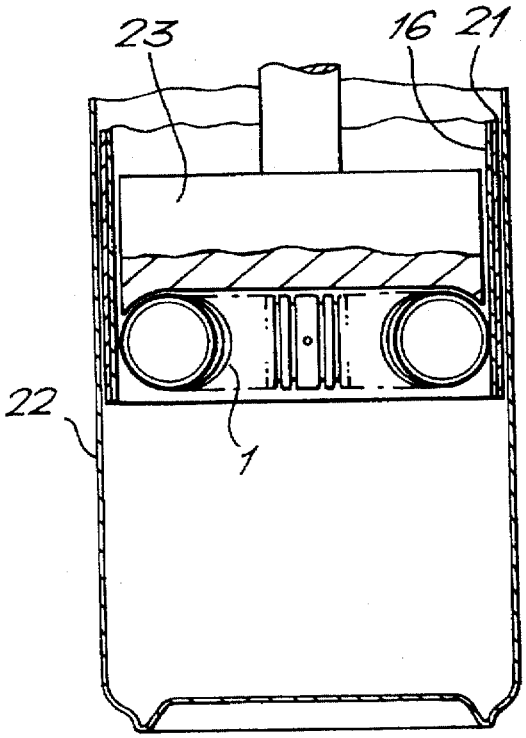
FIG. 6.

BEVERAGE CONTAINER HAVINGING INTERIOR SECONDARY CHAMBER FOR FOAM GENERATION AND METHOD FOR PRODUCING SAME

This specification relates to production of foam for beverages. The specification is particularly, but not exclusively, concerned with the production of a head of foam on beer dispensed from relatively small containers such as cans, bottles and the like.

While many systems exist for providing a stable, tight head on beer dispensed from casks and other bulk containers, it has long been recognized that there are problems if seeking to achieve the same effect on beer dispensed from containers such as cans and bottles. Any head tends to come from natural effervescence of the beer as dissolved carbon dioxide comes out of solution when the container is opened, and from excitation of the beer as it is poured into a glass. To a certain extent the head formation can be improved by using a combination of nitrogen and carbon dioxide, but simply doing this does not produce a head as good as that on beer pumped from casks and the like. There is a particular problem in the case of canned beers intended to provide similar qualities to traditional draught beers, where there is a significantly lower $CO_2$ content than in other canned beers.

It has been proposed, therefor, to inject gas into the beverage when the container is opened, so as to promote formation of bubbles which will provide the foam. This proposal has been done by providing a secondary chamber containing gas at above atmospheric pressure, which is ejected into the main beverage through an orifice when the container is opened, due to the pressure difference across the relatively small orifice. In some known arrangements the secondary chamber communicates permanently while the main body of beverage and in others there is provided a valve.

In GB-A-1,266,351 there is disclosed a bottle with a cap having a secondary chamber attached to it. This chamber is in permanent communication with the main body-of the beverage and contains gas under pressure, at equilibrium with the remainder of the bottle. There are also disclosed cans with secondary chambers in their bases, which are provided with valves. Similar arrangements are shown in GB-A-1,331,425.

In GB-A-2,183,592 there is provided a secondary chamber in the form of a plastic insert which is pushed down inside a can. The chamber is provided with an orifice which communicates permanently with the main body. After sealing the can, beverage enters the insert to compress the gas therein, which is normally nitrogen. It is stated that subsequent ejection of gas and/or beverage causes the formation of a head. The insert is in the form of a plastic moulding.

In WO-A-91/07326 there is disclosed a secondary chamber in the form of a plastic insert which is pre-charged with nitrogen under pressure. The insert has a valve whose properties are altered after filling of the can with beverage and sealing, so that the valve will open when subsequently exposed to the pressure differential when the can is opened. This may be achieved by heating the insert, e.g. during pasteurization of the beer.

Known inserts exhibit various problems in terms of manufacture and handling.

According to an invention disclosed herein, there is provided a container of beverage sealed under pressure, the container being provided with a secondary chamber in the form of a hollow insert adapted to provide a flow of gas through an orifice into the beverage when the container is opened, wherein the insert is in the form of an elongate tubular member whose axis extends around an axis corresponding generally to the axis of the container.

In preferred arrangements the insert will be curved in the form of a part annulus, although the ends could meet to form a complete annulus. Thus the axis of the insert will follow a curved path. However, the insert need not follow a strictly circular or arcuate path. The insert will generally lie in a plane perpendicular to the axis of the container, although a helical form is possible. In general the insert lies against, and extend around, the cylindrical wall of a can or bottle. The insert is preferably resilient, so that it exerts an outward force against the container wall. This resiliences serves at least partly to keep the insert in position. The insert is preferably is provided at the base of the container.

The provision of a flexible insert also assists handling and insertion into the container.

In a preferred embodiment of the invention a flexible, resilient insert is formed in a substantially straight condition—although it may be wound up on a relatively large diameter reel. The insert is then bent into a curved configuration and placed in the container. Alternatively, a flexible resilient insert has an initially curved configuration and then is either straightened out or bent even more to assist in insertion, after which it will reverts to its initial configuration wholly or partly.

In a preferred arrangement, the insert is in the form of an elongate tube sealed at both ends, having a diameter which is several times less than its length. Its length is of the same order of the internal circumference of the container, and preferably somewhat less, in which case the insert extends round a major part of the internal circumference of the container. Alternately can be longer and adopt a helical form.

The arrangement is preferably such that resilience of the insert presses it against the container wall to keep it in position. However, this arrangement may not always be sufficient to locate the insert with a required degree of security, particularly if the container is subjected to rough handling during transportation.

In one embodiment, therefore, a can is provided with an inwardly directed ridge spaced from its base, and the insert is located between the ridge and the base.

In a preferred embodiment, a locating sleeve is provided. This sleeve is in the form of a ring or the like which is pressed down the can, on top of the insert. The sleeve engages the wall of the can resiliently over a sufficient surface area to provide the required locating force. The sleeve preferably is in the form of a circular ring which may be deformed into an oval to assist insertion into the can, and then springs back to its original shape.

The insert may be provided with a series of circumferentially extending ribs, spaced along its length, which assist in permitting bending while providing strength to resist compression when the container is pressurized. The insert may be in the form of a corrugated tube, e.g. of a "concertina" type. In such a case the interior profile may assist in foam generation, possibly by creating turbulence within the insert which creates foam which is ejected. Spaces between the corrugations also assist beer to fill the container properly with the insert in position.

The insert may be of any desired cross section, although a circular cross section is simplest. It may be of elliptical cross section, or shaped to match the interior profile of the bottom of the can, for example. It need not have a regular cross section along its length. The insert may be of any desired length, in accordance with its intended use.

The insert preferably is made by a continuous extrusion process of a type already known per se for tubes and sachets used in other applications. Alternatively a blow moulding process can be used. The ends of the insert can be sealed by plugs, or by mechanical crimping and/or heat sealing. The latter could be carried out either during or after the extrusion or moulding process.

The use of an elongate tubular insert provides the facility for simpler, higher speed manufacturing and handling techniques as described below.

Furthermore, the use of an insert curved round against the wall of a container means that the central region at the base of the container is free. In the arrangements of e.g. GB-A-2,183,592 and WO-A-91/07326 the insert mainly occupies the central region of the container. This arrangement can cause difficulties when filling the container with beer. By using an insert which extends around the periphery of the can, such problems are reduced.

Where it is intended that the insert should contain an "inert" gas such as carbon dioxide and/or nitrogen, this objective can be achieved in a known way by e.g. flushing with nitrogen while in the container. However, the use of an elongate insert made from a continuous process enables the gas to be provided at the forming stage in a relatively easy manner. The insert is made as a single item as opposed to complicated two piece mouldings which have been used previously.

In one preferred process, a tube is continuously extruded. It is subjected to internal pressurization using nitrogen, pushing it outwardly into a mould which forms the corrugations in a manner known from the production of flexible hoses and electrical conduits. Suction also can be employed. The tube is heated and pressure sealed at intervals by the configuration of the mould to define a string of inserts, and this string is wound on a reel. Alternatively, the tube can be sealed at intervals downstream from the moulding system. Typically the string may be 1000 m or more in length. The reel is supplied to a canning plant, where the string is unwound and the inserts separated from each other, as necessary.

One or more orifices can be formed at the time of forming the insert, or just prior to insertion or even after insertion. The orifice could be used as in prior art systems, for example forming a permanent communication between the insert and the beverage as in GB-A-2,183,592; being provided with a temporary sealant such as gelatin as in GB-A-1,266,351; or being provided with a valve which opens only when the container is opened as in WO-A-91/07326. Such a valve is e.g. pressed into the insert. If the orifice is in the form of a slit, extending a small distance around the circumferences of the tube, it can be arranged to be closed under the resilience of the material when the tube is straight, but to open if the tube is bent into a curve with the slit on the outside of the curve.

The formation of tubes, whether corrugated or otherwise, is an advantageous manner of providing an insert. Thus in broad terms, an invention disclosed herein consists of a method of manufacturing an insert for use in a container of beverage sealed under pressure, the insert being adapted to provide a flow of gas into the beverage in the container when the container is opened, so as to promote formation of foam; wherein a continuous tube is formed, the tube is provided with an inert gas atmosphere, and sealed at intervals to define a plurality of elongate gas filled inserts, and when desired the inserts are separated from each other.

Furthermore, an invention disclosed herein provides apparatus for manufacturing an insert for use in a container of beverage sealed under pressure, the insert being adapted to provide a flow of gas into the beverage in the container when the container is opened, so as to promote the formation of foam, the apparatus comprising means for extruding a plastics tube, a mandrel over which the tube passes into a moving mold having a corrugated profile, means connected to a source of inert gas for blowing the inert gas into the tube in the mold, and means for sealing the gas filled tube into a plurality of elongate tubular inserts.

The invention also extends to a insert made by a method or apparatus as set forth above.

In broad terms an invention disclosed herein consists of an insert for use in a container of beverage sealed under pressure, the insert being adapted to provide a flow of gas into the beverage in the container when the container is opened, so as to promote formation of foam, wherein the insert is in the form of an elongate, hollow tube of food grade material, the tube being sealed at both ends and provided with a restricted orifice intermediate its ends, the insert being filled with an inert gas, and being sufficiently rigid to resist collapse when subjected to a pressure difference of 2 bar between its exterior and interior. The degree of rigidity is necessary to ensure that pressurization causes desired effects rather than collapse of the insert and expulsion of the fluid it contains.

The tube may be of plastics such as food grade HDPP (high density polypropylene) or of another suitable material such as aluminium. An advantage of aluminium is that if used in an aluminium can, it facilitates recycling.

An advantage of using tubular or other inserts which can be made by continuous processes such as extrusion, is that it is a simple. matter to provide inserts of different forms and volumes. For example varying the length between the seals will vary the volume of the inserts. It is relatively easy and inexpensive to change an extrusion die to produce inserts with different cross sections and diameters. The position of the orifice is easily variable, by moving it up or down, to alter the performance. These factors make it easier to cope with different products—e.g. beer, stout or lager—and different serving temperatures.

The insert could be provided with a valve arrangement. Preferably, however, to simplify construction as much as possible, the orifice provides a permanent communication between the secondary chamber and the main body of beverage.

In GB-A-2,183,592 it is stated that beverage or gas is ejected from an insert in permanent communication with the main body of beverage, to initiate foam production. However, emphasis is placed on the ejection of the beverage. In GB-B-2,183,592 it is specifically claimed that the ejection of the beverage causes foam production. An insert is shown which has an orifice near to its base. When pressure rises after the can—containing beverage and the insert—is closed, beverage enters the insert through the orifice and compresses the gas therein. When the can is opened the gas in the insert extends and ejects the liquid beverage. It is this which is said to initiate foam production.

It has now been found that significant results are obtained when gas is ejected from an insert. The use of gas is specifically referred to in GB-A-1,266,351 and WO-A-91/07326. In the latter case, and in an arrangement which is commercially available, the insert is pre-charged with gas at above atmospheric pressure. In the former case, there are embodiments in which valved chambers are charged with gas. An embodiment using an insert at the top of a bottle relies upon either charging the insert with gas at above atmospheric pressure and sealing it with a soluble material, or working in a pressurized environment. In any event, the gas in the insert must be at above atmospheric pressure before the container is sealed.

In an arrangement as shown in GB-A-2,183,592, there will be ejection of liquid beverage, almost solely, from the insert if the gas is originally only at atmospheric pressure.

After the container is sealed, there is inevitably an increase in pressure within the container. This may be for several reasons:

(i) Temperature increase;

(ii) Evolution of gas from the beverage;

(iii) Dosing of the container with e.g. liquid nitrogen.

As the pressure increases, liquid beverage enters the insert and compresses the gas therein. When the container is opened and the pressure drops to atmospheric, the liquid is ejected. Once all the liquid has been ejected from the orifice at the bottom of the insert in GB-A-2,183,592, the gas has returned to its original atmospheric pressure and there is no driving force to eject it.

Thus, if it is wished to eject gas under pressure, then one solution is for the insert to contain gas at above atmospheric pressure initially. This causes manufacturing complications. While the process described earlier for manufacturing tubular inserts may be used to pressurize the insert at the manufacturing stage, there is still a problem of forming the orifice while maintaining the pressure.

It has now been ascertained that froth initiation by ejection of gas such as nitrogen, carbon dioxide or a mixture of the two, can be achieved in a simple manner which does not require complex manufacturing conditions. The term "inert gas" used herein refers to such gases and any other suitable gases which will not taint beer.

To achieve this effect with an insert having an orifice in permanent communication with the beverage, the insert is therefore provided with the orifice at a position such that there will be, below the level of the orifice, a substantial volume in which beverage will be trapped.

In this preferred arrangement the insert initially contains gas at atmospheric pressure and is in permanent communication with the body of the container. The container is filled with beverage which will usually be at a temperature lower than a normal dispensing temperature and typically close to 0° C. The beverage is supersaturated with gas, containing carbon dioxide and nitrogen. The nitrogen may be obtained at least in part by dosing the can with liquid nitrogen. Additionally or alternatively the beverage may be pre-nitrogenated. The container is sealed and the pressure inside rises as a result of evolution of the gas from the beverage and the liquid nitrogen dosing if applicable. The beverage will thus enter the insert through the orifice to compress the gas therein. The orifice is spaced from the bottom of the insert by a distance sufficient to define below the orifice a substantial reservoir.

The orifice is positioned such that the liquid beverage entering the insert will fill the reservoir and cover the opening. Gas will then be trapped and compressed above the beverage in the insert.

In practice, pressure in the container at the time of opening for consumption will also have risen due to temperature effects. While filling and sealing may have been carried out at about 0° C., consumption may take place at say 7°–10° C. or even at room temperature of about 20° C.

When the container is vented to atmosphere, the gas in the insert first expels liquid beverage through the orifice, until the level drops to uncover the orifice. At this point the gas is still under significant pressure because the free volume of the insert is reduced by the volume of liquid trapped in the reservoir below the level of the orifice. Thus, the original mass of gas in the insert occupies a smaller volume. The gas is ejected through the orifice until its pressure drops to atmospheric. In a simple case, the volume ejected (at atmospheric pressure) will be approximately equal to the volume of trapped beverage in the reservoir.

In such an arrangement it has been found that the liquid beverage itself does not initiate significant bubble formation to an extent sufficient to generate a head. The jet of gas which is ejected subsequently causes the bubble formation. The arrangement may be such that a relatively small quantity of liquid is above the orifice before the container is opened, so that it is disposed of rapidly before the gas is ejected. With such an arrangement, there may be an additional initial effect in which some gas forces its way through the layer of liquid above the orifice, as soon as the container is opened. This may cause foam to be ejected, and give rise to bubble initiation in the beverage in the container even before the main quantity of gas is ejected through the orifice.

Furthermore, as the gas is subsequently ejected through the orifice, it passes over the trapped liquid in the reservoir. This may lead to some foam being ejected through the orifice together with the main body of gas.

Experiments have shown that ejection of gas in this manner, rather than the ejection of liquid, gives significant bubble formation and leads to a reasonable head on beverages such as beer and stout which are dispensed from cans or bottles.

Thus, in the preferred embodiments a simple orifice is provided in the tubular insert at a position between the top and bottom extremities. The orifice is preferably on the side which will point inwardly to the centre of the container. The orifice can be provided by drilling, laser boring, punching or as part of the initial forming process.

The orifice is preferably positioned such that between 25% and 75% of the volume of the chamber is below the level of the orifice. A preferred value is around 50%.

A preferred total internal volume of the secondary chamber, for conventional beer can sizes in the range of 275 ml to 500 ml, is in the range of 10 ml to 20 ml. A preferred size is about 14 ml to 16 ml, which is appropriate for a number of sizes including 440 ml and 500 ml containers.

As noted above, there may be initial effects in which gas is punched through the beverage in the insert. These may be undesirable and it may be desired to have a more gradual effect. This may particularly be the case where it is wished to avoid adverse temperature dependent effects.

By making the insert from sufficiently flexible material, when the container is first opened and the pressure drops to atmospheric, any initial potentially "explosive" effect within the insert can be avoided. Instead of the contents of the insert being blown suddenly out of the insert, the walls of the insert expand outwardly momentarily under the action of the pressure difference. This increases the internal volume of the insert momentarily, and thereby absorbs some of the initial effect.

The size of the orifice may affect the performance. Typically, the orifice may be circular with a diameter of say 0.1 to 0.5 mm, a preferred size being about 0.3 mm. The length of the orifice, i.e. from the interior of the secondary chamber to the main body of beverage, may also be significant. Too long a passage may result in dissipation of energy. Typically, the orifice will have a length in the range of 0.25 to 1 mm, a preferred value being about 0.5 mm. The length will usually be governed by the thickness of material used but this can be modified locally in the region of the orifice.

Steps may be taken to prevent air entering the insert once it has been filled with gas and the orifice formed. This prevention may be achieved by e.g. providing an environment of inert gas in which the insert is handled, and/or by forming the orifice after the secondary chamber is in the can, immediately before filling. This prevention could be achieved alternately by a laser, if necessary using a system of mirrors or fibre optics. It may be desirable to form the orifice while the secondary chamber is in one orientation, where orifice formation is easy, and then to adjust the orientation so that the orifice is moved to the correct position relative to the can. However, in a rapidly moving continuous operation the delay between the orifice being formed and the beverage covering the insert in the container may not be such as to cause problems.

Filling of the container with beverage generally is carried out at a temperature close to 0° C., a typical range being 1°–5° C. A typical serving temperature may be in the range of 7°–10° C. However, consumers may refrigerate beers further and serve them at temperatures of say 4°–5° C. Even so, pressure in the can will be substantially above that at the time immediately prior to sealing, due to evolution of gas, and nitrogen dosing. Typically beer used may have $CO_2$ at say 1:1.2. It may be desirable to have a high level of nitrogenation, at say 60–70 ppm.

The initial pressure inside the insert is 1 bar (absolute). After sealing the pressure inside the container—and thus the insert—rises to about 3 bar and then rises still further with temperature increase.

The mass of gas which is trapped in the insert is approximately that which occupies the volume of the insert at atmospheric pressure. This is compressed when liquid beverage enters the insert and it is the energy stored in this mass of gas which provides the driving force for foam creation. It has been found that it is advantageous to increase this mass and that this can be done without increasing the volume of the insert.

There will always be the same volume of fluid in the insert, under whatever equilibrium pressure there is within the container. However, it is advantageous to increase the mass of gas. At a given temperature and equilibrium pressure, an increase in the mass of gas means an increase in volume of the gas. Accordingly, it is assumed there must be a corresponding decrease in the volume of liquid beverage within the insert.

According to a preferred embodiment, therefore, the container is provided with an insert towards its base, filled with beverage while still leaving a headspace, and sealed. A certain volume of liquid beverage enters the insert through the orifice, and compresses the gas therein in the manner described earlier. Following this entry, however, the container is inverted so that the orifice in the insert is in communication with the gas which forms the headspace in the container. At this point, the insert contains a volume of liquid beverage and a volume of gas, at equilibrium with the headspace gas. However, if the temperature of the inverted container is then raised it has been found that an improved effect is obtained when the container is cooled, placed the right way up, and opened.

The reason for this improved performance is assumed to be that an increased mass of gas is trapped within the insert. When the temperature is increased, the pressure inside the container increases. It is assumed that the gas space in the insert is in, or comes into, communication with the gas in the headspace when the can is inverted, via the orifice. This means in most, if not all cases, that the orifice is positioned within the headspace. Beverage in the insert may cover the orifice, but presumably this is displaced.

Accordingly the volume within the insert will be occupied by a greater mass of gas.

In any event, after heating the container in the inverted state, with the orifice in communication with the headspace, the insert contains a greater mass of gas than it did previously. When the can is inverted, it is this increased mass which is trapped, thus improving performance. When the container is cooled to a normal temperature and the pressure is reduced to about 3 bar, the pressure inside the insert is the same as before invention and heating, but the mass of gas has increased.

Insertion and heating of the container can be carried out in a convenient manner using conventional pasteurization techniques. In pasteurization the container is heated to 63° C. and then cooled. If the container is inverted, pasteurized, and then cooled and turned the right way up again, the improved effect will have been gained.

Thus, according to an aspect of an invention disclosed herein, there is provided a method of manufacturing a sealed container of beverage under pressure including means to promote the formation of foam by the ejection of a stream of gas from a chamber when the container is opened, comprising the steps of:

(a) Providing a hollow chamber containing a mass of gas adjacent the base of the container, the chamber having an orifice providing open communication between the interior of the chamber and the main body of the container;

(b) Filling the container with beverage containing gas in solution to a level which will leave a headspace when the container is sealed;

(c) Subsequently sealing the container, whereby there is an increase in pressure and beverage enters the hollow chamber through the orifice, to compress the mass of gas;

(d) Subsequently inverting the container;

(e) Heating the container so as to provide a further increase of pressure inside the container while the container is inverted, whereby the insert is caused to contain an increased mass of gas; and subsequently (f) Cooling the container; and (g) Placing the container the right way up whereby an increased mass of gas is trapped within the chamber.

Preferably the arrangement is such that beverage in the chamber covers the orifice, when the container is the right way up, both before and after the heating step. Preferably the arrangement is such that the orifice of the chamber is in communication with the headspace gas when the container is inverted.

Some embodiments of the invention will now be described by way of example and with reference to the accompanying drawings, in which:

FIG. 4 is a diagrammatic view of apparatus for preparing an insert for placing in a can;

Figure 7:
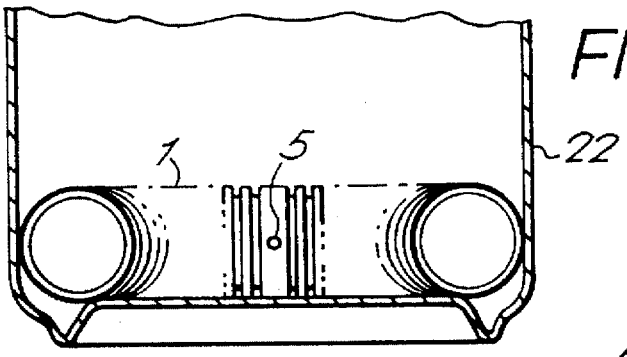
Figure 8:
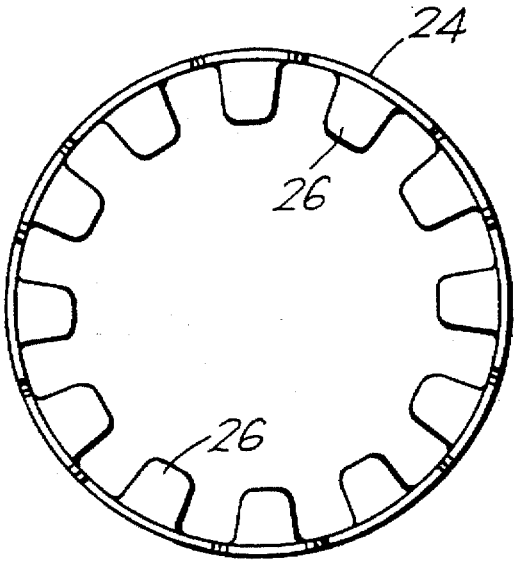
Figure 9:
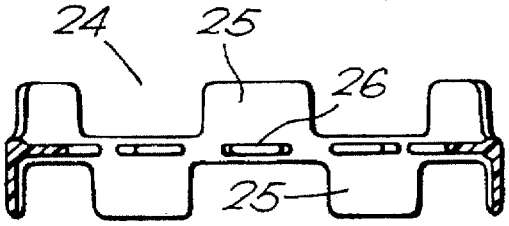
Figure 10:
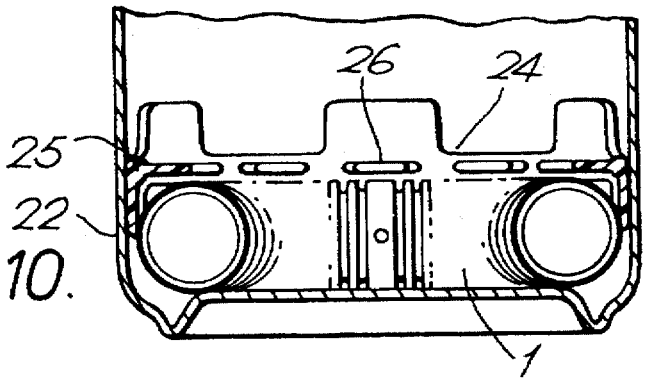
Figure 11:
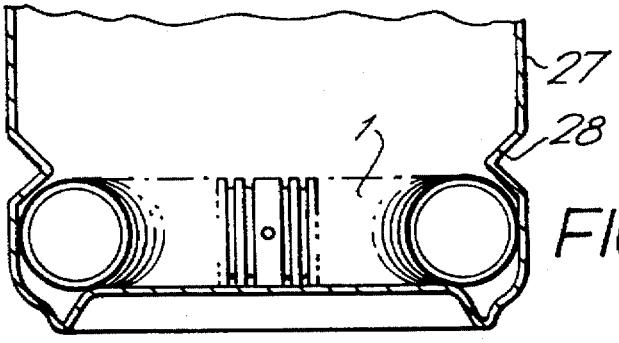
Figure 12:
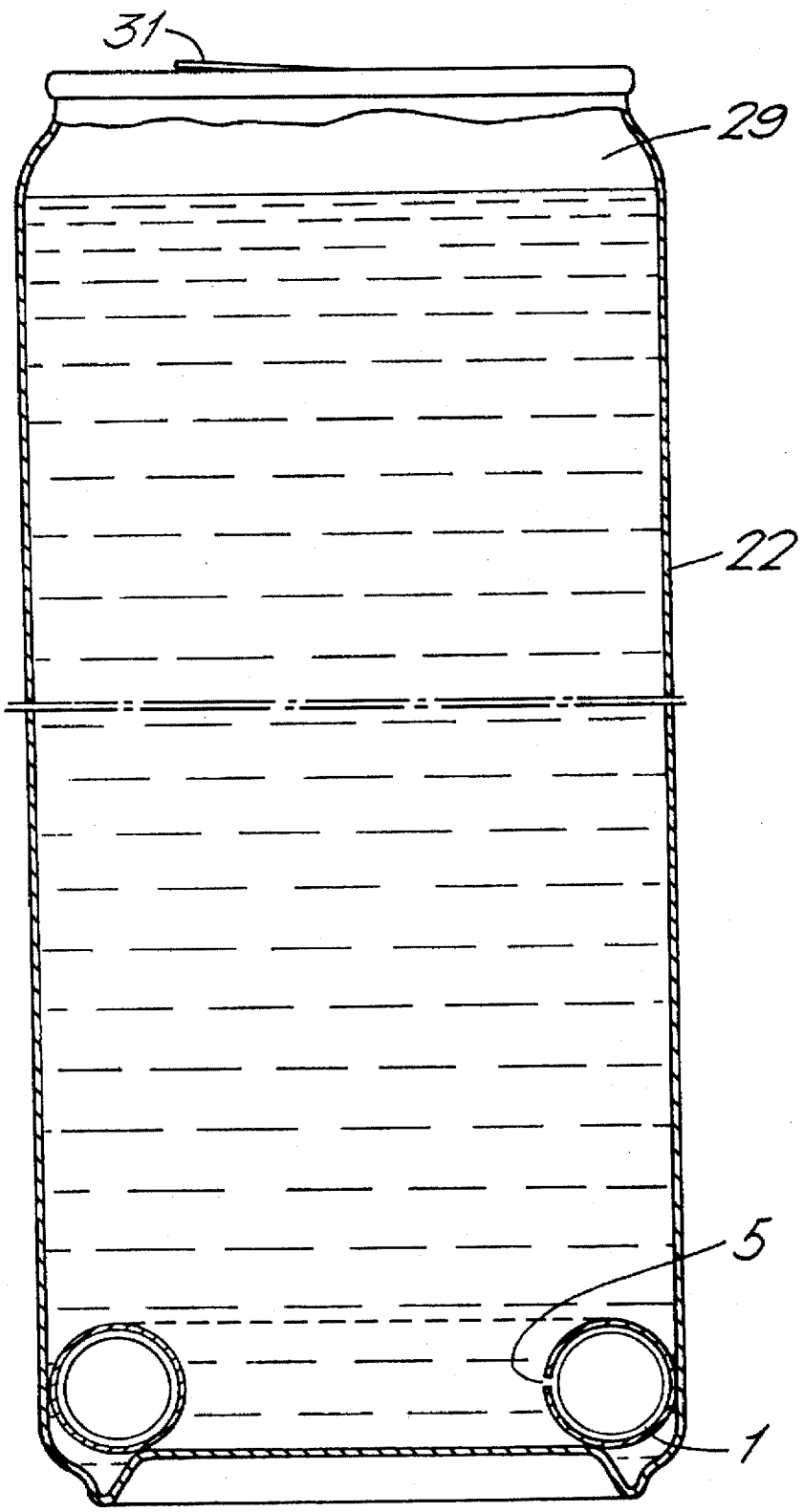
Figure 13A:
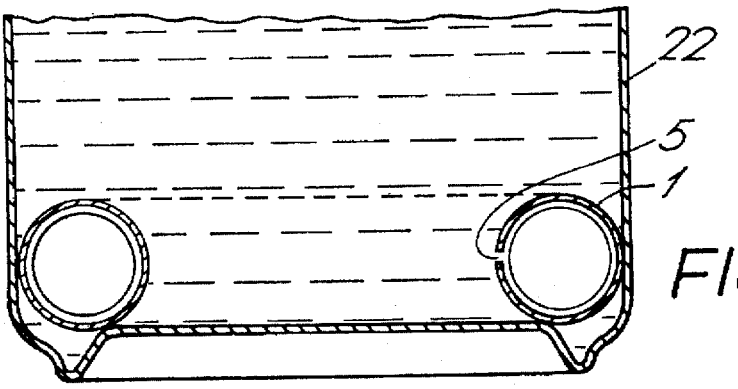
Figure 13B:
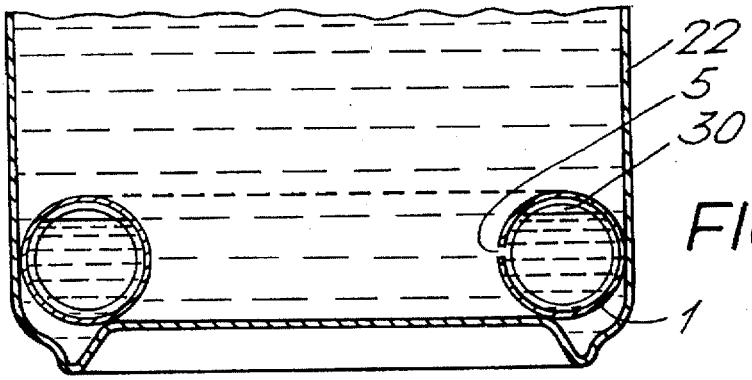
Figure 14A:
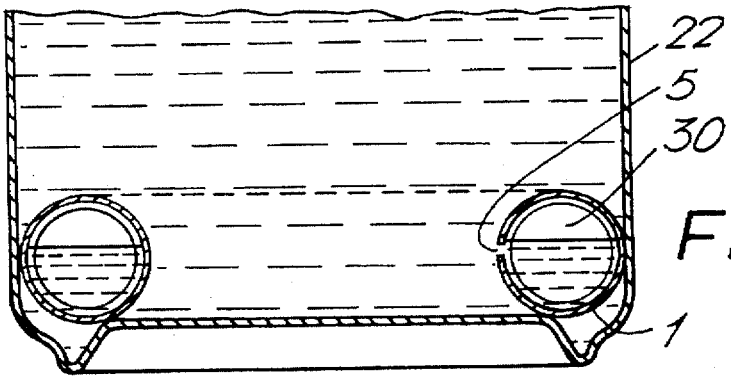
Figure 14B:
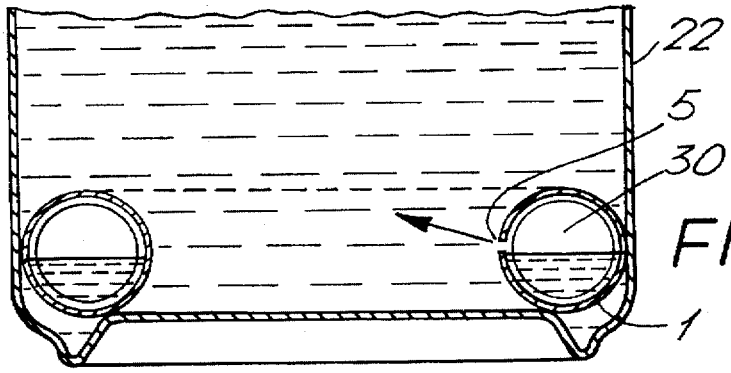

FIGS. 5*a* and 5*b* show later stages in preparing the insert;

FIG. 6 shows the insert being positioned in a can;

FIG. 7 shows the insert positioned at the bottom of the can;

FIG. 8 is a plan view of a sleeve for retaining the insert;

FIG. 9 is a section through the sleeve;

FIG. 10 shows the sleeve in position over the insert;

FIG. 11 shows an alternative embodiment;

FIG. 12 shows a complete can with an insert in place; in this and the following figures the sleeve is omitted for reasons of clarity;

FIGS. 13(*a*) and 13(*b*) show stages in filling and sealing the can;

FIGS. 14(*a*) and 14(*b*) show stages after opening the can; and

Figure 15:
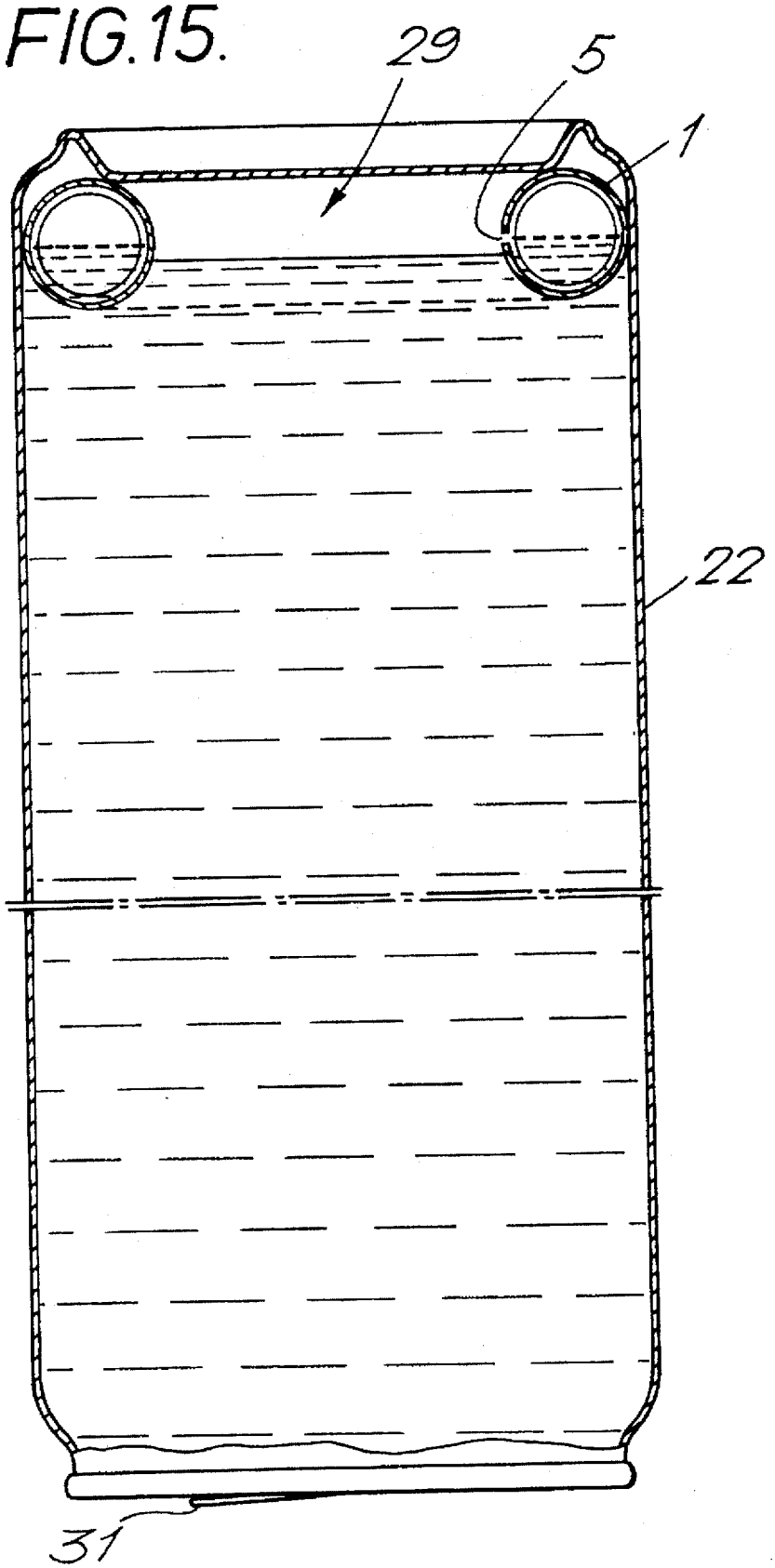

FIG. 15 shows the can in an inverted condition for pasteurization.

Figure 2:
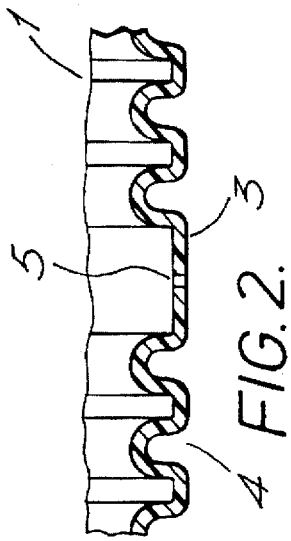
FIG. 2 is a detailed section of the insert, showing the position of an orifice made at a later stage.
Figure 1:
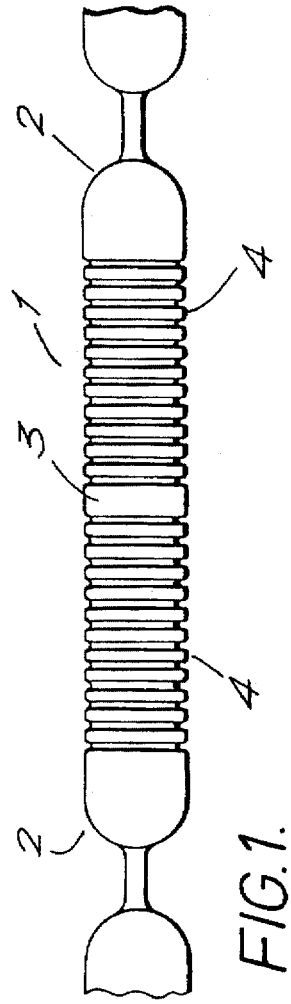
FIG. 1 is a side view of an insert, joined at either end to other inserts.

The insert 1 shown in FIGS. 1 and 2 is in the form of an extruded tube of food grade HDPP. It has sealed regions 2 at either end where it is joined to other inserts, a plain middle region 3, and corrugated portions 4. The middle region 3 will be provided with an orifice 5 at a later stage, in its side. The insert is run in the form of an elongate, hollow, resilient tube which, once separated from the other inserts, can be bent to a desired configuration.

Figure 3:
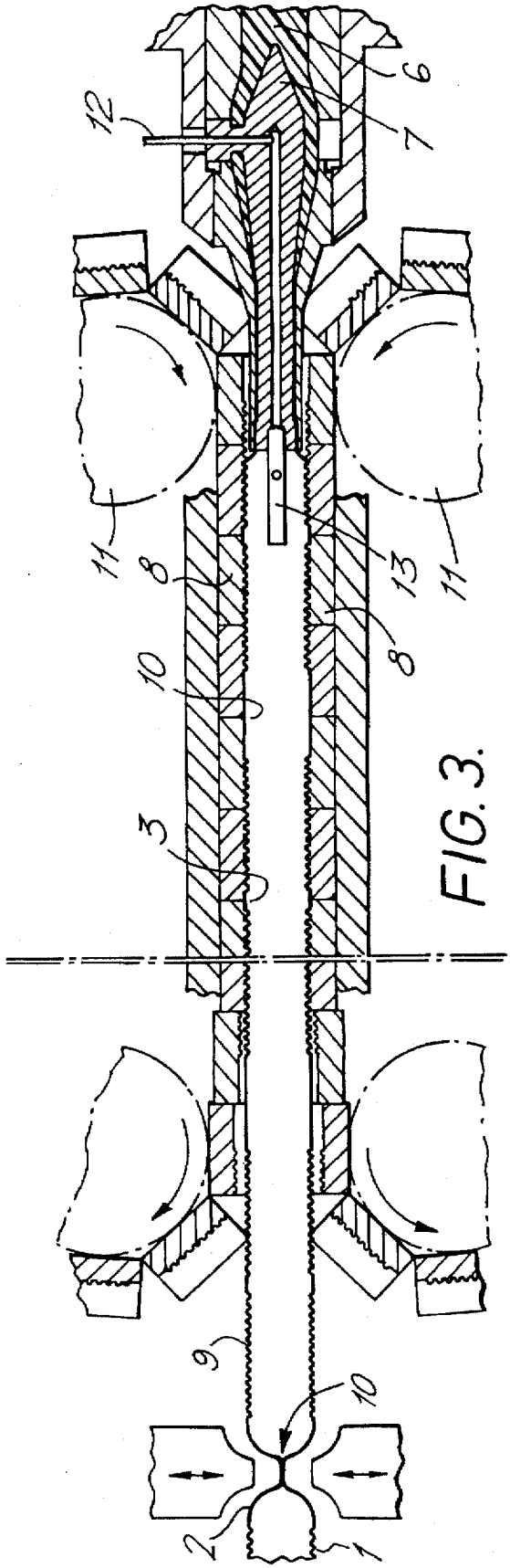
FIG. 3 is a diagrammatic view of apparatus used to make inserts.

As shown in FIG. 3, the inserts are made by an extrusion technique. Plastics material 6 flows from an extruder over a mandrel to form a continuous tube. This passes into a chain of moving semi-cylindrical mold blocks 8. The top and bottom blocks co-operate to define a corrugated tube 9 which will form the inserts. The blocks are configured to provide the central region 3 for each insert, and a region 10 which will form the end regions 2 of the inserts. The blocks are moved along by a conveying system 11.

A source of nitrogen is connected to a tube 12 which passes through the mandrel 7 into the tube 9. This pumps nitrogen at about atmospheric pressure through an orifice 13 to push the tube into the mould blocks 8. Suction may be provided also. The blocks pass through a cooling sleeve 14, to solidify the tube properly.

After leaving the molding phase, the tube passes to a sealing station where punches 15—which may be heated—act upon the region 10 to define the end 2 of an insert and seal it. There are thus provided a series of sealed inserts, joined to each other and containing nitrogen. This series may be wound up on a drum for future use.

The inserts are to be placed in a can of beer just prior to the can being filled.

FIG. 4 shows one stage in the preparation for this. An insert 1 is presented to a station where there is a receiving sleeve 16 and a cutter 17. The cutter severs the sealed region joining the insert 1 to the next insert, so that the insert is now free but is still fully sealed. A plunger 18 then pushes the insert laterally through an aperture 19 into the sleeve 16. The plunger 18 has a piercing point 20 which forms the orifice 5 as this is being done. The orifice 5 is about half way up the insert.

FIG. 5*a* shows the insert 1 within the sleeve 16. It will be noted that the ends 2 are projecting, which would make insertion in a can difficult. Accordingly, disposed around sleeve 16 for relative rotation is a sleeve 21. Rotation of this wipes the ends of the insert round, as shown in FIG. 5*b*.

At this point, the insert is ready to be placed in the can. This is shown in FIG. 6, which illustrates a stage of insertion into a can 22. The insert 1 is within sleeves 16 and 21, and a piston 23 is also provided. When the assembly reached the bottom of can 22, the sleeves and piston are activated in an appropriate order to leave the insert at the bottom of the can. This is shown in FIG. 7.

The sleeves hold the insert in a compressed condition. The arrangement is such that the sleeves containing the insert may pass through a restricted opening into the can. As shown, the sleeves fit closely within the can. In some arrangements where the opening diameter is much smaller than the main can diameter, the sleeves will be spaced a greater distance from the can wall.

The insert 1 springs out under its own resilience to engage the wall of the can 22, extending around the wall. It lies on the base of the can and has the form of a part annulus whose centre line is curved around the longitudinal axis of the can. The plane of the annulus is perpendicular to the axis of the can. The orifice 5 is directed inwardly to the centre of the can. Depending upon the length of the insert, it may form almost a complete annulus or may form e.g. a horseshoe shape.

FIGS. 8 and 9 show a retaining sleeve 24 to assist in keeping the insert down at the base of the can. The sleeve is in the form of a resilient ring of it 25 food grade HDPP. It has castellations 25 around its top and bottom, and a plurality of inwardly projecting tabs 26 around the inside. The ring 24 can be squeezed into e.g. an oval to assist placing in the can. As shown in FIG. 10, when the ring 24 is in position at the bottom of the can, the castellations 25 engage the wall of the can so as to resist dislodgement. The ring 24 keeps the insert 1 firmly in place.

FIG. 11 shows an alternative method for locating the insert. In this, a can 27 is provided with an inwardly directed circumferential ridge 28 under which the insert 1 is retained.

The location of the insert 1 and locking ring 24 are performed quickly after the insert is pierced. Beer is then added quickly to the can to cover the insert and prevent excessive air (containing oxygen) getting into the insert. The beer contains carbon dioxide and may have been nitrogenated. Additionally or alternatively a portion of liquid nitrogen may be added to the beer, once in the can. The can is then sealed and the position is as shown in FIG. 12 (where the retaining ring has been omitted) and in FIG. 13(*a*). A headspace 29 of gas is provided above the beer. Filling takes place at a low temperature, say 1°–5° C.

Virtually immediately after sealing the position is as shown in FIG. 13(*b*). The pressure with the can has risen, and liquid has entered the insert 1 through the orifice 5. The liquid beverage covers the orifice and compresses a small headspace of gas 30 in the insert.

If the gas in the container is assumed to be ideal, the following condition is satisfied:

$$\frac{PV}{T} = \text{constant or } \frac{P_1V_1}{T_1} = \frac{P_2V_2}{T_2}$$

where:

P=Pressure

V=Volume

T=Temperature (in degrees Kelvin)

In a typical case, the volume of the insert is 15.7 ml and the can is filled at approximately 0° C., or 273 K. The $CO_2$ level is equivalent to 1.00 V/V (at s.t.p) at equilibrium. The Nitrogen level is equivalent to 72.0 mg/liter at equilibrium. After sealing, the pressure inside the can rises to 3.08 bar (absolute). As the insert is originally at atmospheric pressure (1 bar absolute), the new volume of gas inside the insert, after equilibrium is reached at 0° C. will be:

$$V_2 = \frac{(1\text{ bar}) \times (15.7\text{ ml})}{(3.08\text{ bar})} = 5.1\text{ ml}$$

There is, therefore, 15.7–5.1=10.6 ml of beer inside the insert.

As the temperature rises, there will be an increase in pressure leading to an increased volume of beer inside the insert. At 4° C., 8° C. and 20° C. the pressures (bar absolute) would be 3.22, 3.37 and 3.85.

When the can is eventually opened, e.g. by means of a ring pull 31, the gas 30 ejects liquid beverage through the orifice 5, as shown in FIG. 14(*a*).

Within a short period the liquid level within the insert 1 drops to below the level of the orifice 5, as shown in FIG. 14(*b*). At this point the gas in headspace 30 is still compressed and starts to issue from the orifice 5. It is this which initiates significant bubble formation.

Such an arrangement gives an effect. However, the effect is enhanced if the can is inverted and heated. Such an arrangement is shown in FIG. 15. As shown, the orifice 5 is in communication with the headspace 29. In some arrangements, all or almost all of the insert could be in the headspace. Whilst in this inverted state the can is subjected to pasteurisation. It is heated to above 60° C., say 63° C., and then allowed to cool to about 23° C. It takes about 20 minutes for this process, after which the can is turned the right way up. During the inverted period the pressure rises. It is assumed that liquid in the insert 1 is displaced by gas. When the can is turned the right way up and the pressure eventually drops to about 3 bar, there is a greater mass of gas trapped, which produces an enhanced effect when the can is opened.

It will be appreciated that modifications may be made.

We claim:

1. A cylindrical container of beverage sealed under pressure, the container having means defining a secondary chamber in the form of a hollow insert adapted to store a gas therewithin and forming an orifice therein, the insert having means for providing a flow of the gas through the orifice into the beverage when the container is opened, wherein the insert is in the form of an elongated tubular member whose axis extends around a central axis of the container.

2. A container as claimed in claim 1, wherein the container has a cylindrical wall and the insert lies against and extends around the interior of said wall.

3. A container as claimed in claim 2, wherein the insert is resilient and exerts an outward force against the wall.

4. A container as claimed in claim 2, wherein a resilient sleeve is provided to assist in retaining the insert, the sleeve being positioned above the insert and engaging the wall of the container.

5. A container as claimed in claim 1, wherein the insert is positioned at a base of the container.

6. A container as claimed in claim 1, with an orifice, the orifice located so as to establish permanent flow communication between the interior of the insert and the beverage in the container.

7. A container as claimed in claim 6, wherein the insert contains beverage which has entered the insert through the orifice.

8. A container as claimed in claim 7, wherein the insert has gas therein as a headspace above the beverage.

9. A container as claimed in claim 7, wherein the beverage in the insert covers the orifice when the container is in an upright position.

10. A container as claimed in claim 7, wherein the orifice is positioned when the container is in an upright position such as to define below the orifice a volume in the insert in which beverage is held.

11. A container as claimed in claim 10, wherein the orifice is provided in a region approximately mid-way up the insert which is arranged in a flat planar fashion.

12. A container as claimed in claim 6, wherein the orifice is positioned on the interior of the curved insert.

13. A container as claimed in claim 1, wherein the insert is in the form of an extruded tube, sealed at both ends.

14. A container as claimed in claim 13, wherein the insert is corrugated.

15. A container as claimed in claim 1, which has been subjected to a pasteurizing treatment in an inverted condition.

16. A container as claimed in claim 15, wherein there is a headspace of gas in the container and the orifice of the insert communicates with the headspace when the container is inverted.

17. A method of manufacturing an insert for use in a cylindrical container of beverage sealed under pressure, the insert having means provided with a supply of a pressurized inert gas to provide a flow of the inert gas into a beverage in the container when the container is opened so as to promote formation of foam; forming a continuous tube; providing the tube with an inert gas atmosphere; sealing the tube at intervals to define a plurality of elongate gas filled inserts; and separating the inserts from each other when desired.

18. Apparatus for manufacturing an insert for use in a cylindrical container of beverage sealed under pressure, the insert having means provided with a supply of a pressurized inert gas to provide a flow of the inert gas into a beverage in the container when the container is opened so as to promote formation of foam, the apparatus comprising in combination: means for extruding a plastic tube, a mandrel over which the tube is passed into a moving mold having a corrugated profile, means connected to a source of the inert gas for blowing the inert gas into the tube in the mold, and means for sealing the gas filled tube into a plurality of elongate tubular inserts.

19. An insert for use in a cylindrical container of beverage sealed under pressure, the insert having means provided with a supply of a pressurized inert gas to provide a flow of the inert gas into a beverage in the container when the container is opened so as to promote formation of foam, wherein the insert is in the form of an elongate hollow tube of food grade material, the tube being sealed at both ends and provided with a restricted orifice intermediate its ends, the insert being filled with an inert gas and being sufficiently rigid to resist collapse when subjected to a pressure difference of 2 bar between its exterior and interior.

* * * * *